US006640999B2

(12) United States Patent
Peterson

(10) Patent No.: US 6,640,999 B2
(45) Date of Patent: Nov. 4, 2003

(54) DOSE DISPENSING PUMP FOR DISPENSING TWO OR MORE MATERIALS

(75) Inventor: Erik Peterson, Grayslake, IL (US)

(73) Assignee: Unilever Home & Personal Care USA, division of Conopco, Inc., Chicago, IL (US)

( * ) Notice: Subject to any disclaimer, the term of this patent is extended or adjusted under 35 U.S.C. 154(b) by 141 days.

(21) Appl. No.: 10/054,511

(22) Filed: Nov. 13, 2001

(65) Prior Publication Data

US 2003/0089738 A1 May 15, 2003

(51) Int. Cl.[7] ..... B67D 5/52

(52) U.S. Cl. ..... 222/135; 222/321.1; 222/380; 222/494

(58) Field of Search ..... 222/135, 137, 222/145.1, 252, 255, 320, 321.1, 321.6, 321.7, 321.8, 372, 378, 380, 382, 464.1, 491, 494, 511

(56) References Cited

U.S. PATENT DOCUMENTS

| | | | | |
|---|---|---|---|---|
| 4,273,268 A | | 6/1981 | Wickenberg | |
| 4,396,132 A | | 8/1983 | Christensen | |
| 4,949,874 A | | 8/1990 | Fiedler et al. | |
| 5,224,627 A | * | 7/1993 | Weag | 222/135 |
| 5,310,112 A | * | 5/1994 | Meshberg | 222/482 |
| 5,398,846 A | | 3/1995 | Corba et al. | |
| 5,405,057 A | | 4/1995 | Moore | |
| 5,617,976 A | * | 4/1997 | Gueret | 222/380 |
| 5,673,824 A | | 10/1997 | Evans | |
| 6,082,588 A | * | 7/2000 | Markey et al. | 222/137 |

FOREIGN PATENT DOCUMENTS

| | | |
|---|---|---|
| EP | 0 318 834 | 11/1988 |
| EP | 0 953 381 | 11/1999 |

OTHER PUBLICATIONS

International Search Report.

* cited by examiner

*Primary Examiner*—Gene Mancene
*Assistant Examiner*—Patrick Buechner
(74) *Attorney, Agent, or Firm*—Milton L. Honig

(57) ABSTRACT

The present invention relates to a dosing pump for dispensing two or more liquids, gels, slurries and/or pastes, and adapted to be connected to two or more containers for said two or more as liquids, gels, slurries and/or pastes. The dosing pump may comprise an operating button, and two or more liquid, gel, slurry and/or paste dispensing assemblies. Each such assembly may comprise an actuator which is in mechanical contact with said operating button, so that each actuator, on each dispensing assembly, is simultaneously or nearly simultaneously actuated by movement of said operating button. The dosing pump of the present invention may have a flap valve assembly situated within plates between the liquid, gel slurry and/or paste assembly, and the container, which carries the liquid, gel, slurry and/or paste.

15 Claims, 10 Drawing Sheets

16
26b
26a
24b
24a
12
10
20b
20a 14
15b
35b
16b
35a
16a
38b
40b
15a
38a
40a
30b
34
29b
30a
29a
54
10
80
52
50

29b
44
54
29a
74b
78
77
74a
76b
52
76a
10
68b
56
66b
68a
62b
50
64b
60b
66a
60a
62a
64a 40b
38b
38a
40a
34b
34
31
36b
34a
30b
36a
30a
35b
35a
10
80
36b
44
29b
36a
54
46b
46a
29a 16
14
34
24a
40a
20c
12
30a
48a
29a
74a
54
76a
52
60a
50
20a
10
20c
28a

DOSE DISPENSING PUMP FOR DISPENSING TWO OR MORE MATERIALS

BACKGROUND OF THE INVENTION

The present invention relates to a dose dispensing pump, and in particular to a finger operated dose dispensing pump, which can serve to dispense metered amounts of two or more liquids, gels, slurries and/or pastes, simultaneously, or nearly simultaneously.

There is often a need to dispense metered amounts of two or more materials such as liquids, gels, slurries and/or pastes, simultaneously, or nearly simultaneously. This need often arises because the two or more materials which need to be dispensed, must be kept physically separated until about the actual time of dispensing. It is sometimes the case that if the two or more materials, which can be liquids, gels, slurries and/or pastes, were allowed to mix prior to dispensing, that they would chemically or physically interact so as to become inert or ineffective for the intended purpose. However, if the two or more materials are dispensed simultaneously, or nearly simultaneously, and caused to physically mix during dispensing or shortly thereafter, that they will then interact for an intended purpose.

Finally, it is also often necessary for the two or more materials to be dispensed in metered amounts, for example, in specific weight ratios to each other because this may be needed in order to achieve the desired physical or chemical interaction between the two materials.

As noted above, it is often also necessary that said two or more materials be mixed upon dispensing, or that they be dispensed in close physical proximity to each other so that they can be mixed together shortly after being dispensed. For example, it may be necessary for a particular glue and its "curing" agent to be stored in separate physical containers, and yet to be mixed together in metered amounts upon dispensing. It may also be necessary for two or more materials in a tooth cleansing composition to be stored in separate physical containers, and then to be mixed together upon dispensing and use. Also in cosmetic fields, such as hair coloring, an oxidative hair coloring dye must often be kept physically separate from its "developer", which can contain a peroxide, and yet these two materials may also be required to be dispensed in metered amounts, simultaneously, or nearly simultaneously with mixing or with mixing shortly after the dispensing. If these dispensing conditions are not meant the oxidative hair dye and its developer may lose their potency or may not function properly.

The present invention relates to dose dispensing pumps which can supply metered, simultaneous or near simultaneous dispensing of two or more liquids, gels, slurries and/or pastes, wherein such dispensing can occur from separate exit ports or nozzles, or from the same exit port or nozzle. In the former case the two or more materials can be mixed shortly after they have been dispensed. In the latter case, the two or more materials can be mixed at the same time that they are being dispensed. The present invention provides efficient dose dispensing pumps which are economical and which have few parts, and which can dispense two or more liquids, gels, slurries and/or pastes. The dose dispensing pumps of the present invention can keep said two or more liquids, gels, slurries and/or pastes physically separate until the time of dispensing.

Patents and publications which relate to the present field of invention are as follows:

U.S. Pat. No. 5,673,824 discloses a dosing pump for liquids which has a cylindrical chamber for receiving the liquid to be dispensed, a piston located in the chamber slidable between a rest and a dispensing position. A valve near the inlet of the cylindrical chamber closes the chamber to block incoming liquid flow when the pump is moved to the dispensing position and opens for drawing liquid into the chamber as the piston returns to the rest position. A valve near the outlet of the pump allows liquid flow to the outlet during the dispensing stroke and blocks the outlet during the return stroke. The pump is formed of one or more compatible plastic materials which are recyclable and compatible so that the entire pump may be recycled as a unit without disassembly and sorting of parts.

U.S. Pat. No. 5,405,057 discloses an apparatus for an improved manually actuated pump for dispensing a liquid within a container comprising a pump body having an internal pump cylinder secured to the container. A piston is slidably disposed within the internal pump cylinder of the pump body with a pump stem having a stem end extending external the pump body. The stem end supports an actuator having a nozzle communicating with an internal stem passage of the pump stem for discharging the liquid from the container through the nozzle. A lock comprises a projection extending radially outward from the pump stem and an overhang extending radially inwardly relative to the internal pump cylinder of the pump body for preventing movement of the actuator in either an extended position or a retracted position upon rotation of the pump stem.

U.S. Pat. No. 4,273,268 discloses an improved fluid spray pump for spraying a fluid from a fluid container through a terminal orifice comprising a housing having an internal cylinder with a first and a second end. A collar with an internal collar aperture is mounted adjacent the first end of the housing internal cylinder. A pump barrel is slidably received in the internal collar aperture and includes a barrel internal bore communicating with a terminal orifice in the pump barrel. A piston comprising a piston stem is received in the barrel internal bore of the piston barrel and with a piston head received within the housing internal cylinder. Channels are provided along the piston stem for communicating the housing internal cylinder with the terminal orifice. An annular seal is slidably mounted relative to the piston and the pump barrel for sealing the channel means when the annular seal abuts a shoulder formed between the piston head and the piston stem. The annular seal enables fluid flow through the channel means to the terminal orifice when the annular seal is displaced from the piston shoulder by movement of the pump barrel toward the second end of the housing internal cylinder.

EP 0 953 381 A2 discloses a fluid pump dispenser which has a pump body including a pump cylinder defining a pump chamber with a valve controlled product inlet passage leading to the chamber. A manually reciprocable pump plunger having a hollow stem defining a discharge passage leading from the chamber is slidably mounted in the body. A pump piston is mounted on the inner end of the stem for relative sliding movement. A plunger return spring biases the plunger into a raised position. The piston is limited for relative sliding movement between discharge open and closed positions, the piston having an annular projection defining a discharge valve seated in an annular groove of a plug element fixedly mounted to the stem at its inner end. A lost-motion effect is created between the piston and the stem which closes the discharge valve during the pressure stroke and opens the discharge during the intake stroke. The plunger element is capable of being locked in up and down positions, an outer surface of the plug element sealing the inlet passage closed in the plunger lock-down position.

SUMMARY OF THE INVENTION

The present invention relates to a dosing pump for dispensing liquids, gels, slurries and/or pastes, and adapted to be connected to two or more containers for said two or more liquids, gels, slurries and/or pastes. The dosing pump may comprise an operating button, and two or more liquid, gel, slurry or paste dispensing assemblies. Each such assembly may comprise an actuator which is in mechanical contact with said operating button, so that each actuator, on each dispensing assembly, is simultaneously or nearly simultaneously actuated by movement of said operating button. Each liquid, gel, slurry and/or paste dispensing assembly further comprises:

a) a dispensing element;

b) a cylindrical chamber in flow communication with the dispensing element;

c) a piston or bellows sealably and slidably mounted with said cylindrical chamber;
having a stroke for motion between a rest position and a dispensing position at corresponding opposite rest and dispensing ends of the stroke;

d) an inlet valve means in fluid communication with said cylindrical chamber and said dip tube leading to said container, and said outlet valve means;

e) and an outlet valve means in fluid communication with said dispensing element, said inlet valve means and said outlet valve means are disposed in one or more plates situated between each said container and its corresponding liquids, gels, slurries and/or pastes dispensing assembly.

When the piston or bellows is being urged in the direction of the rest position, said inlet valve means is in flow communication with said dip tube and said cylindrical chamber, but is cut off from flow communication with said outlet valve means. Consequently, liquid, gel, slurry or paste is drawn by suction from the container through the dip tube and into said cylindrical chamber.

When the piston or bellows is being urged in the direction of the dispensing position, said inlet valve means is in flow communication with said cylindrical chamber and said outlet valve means, but is cut off from flow communication with the dip tube in the container. Consequently, liquid, gel, slurry or paste is forced by compression or mechanical force through the outlet means and the dispensing element to the consumer.

DETAILED DESCRIPTION OF THE INVENTION

As used herein "nearly simultaneously" means within a very short time such as within about 0.1 to about 2 seconds each other, or about 0.5 to about 1 seconds each other. As used herein liquids, gels, slurries and/or pastes also includes other flowable materials. The term "flow communication" or "fluid communication" is used in two ways in the present specification. In one way it is used to describe the pathway of the liquid, gel, slurry and/or paste within the embodiment of the pump. In an another way it is used to mean that the valve means actually provides for an open pathway for the of the liquid, gel, slurry and/or paste.

The present invention relates to a dosing pump for dispensing two or more liquids, gels, slurries and/or pastes, and adapted to be connected to two or more containers for said two or more liquids, gels, slurries and/or pastes. The dosing pump may comprise an operating button, and two or more liquids, gels, slurries and/or pastes dispensing assemblies. Each such assembly may comprise an actuator which is in mechanical contact with said operating button, so that each actuator, on each dispensing assembly, is simultaneously or nearly simultaneously actuated by movement of said operating button. Each liquid, gel, slurry and/or paste dispensing assembly further comprises:

a) a dispensing element;

b) a cylindrical chamber in flow communication with the dispensing element;

c) a piston or bellows sealably and slidably mounted with said cylindrical chamber;
having a stroke for motion between a rest position and a dispensing position at corresponding opposite rest and dispensing ends of the stroke;

d) an inlet valve means in flow communication with said cylindrical chamber and said dip tube leading to said container, and said outlet valve means; and e) an outlet valve means in flow communication with said dispensing element, said inlet valve means and said outlet valve means are disposed in one or more plates or gasket situated between each said container and its corresponding liquid or paste dispensing assembly.

When the piston or bellows is being urged in the direction of the rest position, said inlet valve means is in flow communication with said dip tube and said cylindrical chamber, but is cut off from flow communication with said outlet valve means. Consequently, liquid, gel, slurry and/or paste is drawn by suction from the container through the dip tube and into said cylindrical chamber.

When the piston or bellows is being urged in the direction of the dispensing position, said inlet valve means is in flow communication with said cylindrical chamber and said outlet valve means, but is cut off from flow communication with the dip tube in the container. Consequently, liquid, gel, slurry and/or paste is forced by compression or mechanical force through the outlet means and the dispensing element to the consumer.

The present invention also relates to a method for simultaneously or nearly simultaneously dispensing two or more liquids, gels, slurries and/or pastes through the use of a dosing pump of the invention.

The present invention also relates to a single bottle or container which is divided into two or more compartments by walls, membranes and the like. Each compartment would be accessed by a dip tube of the pumping device of the invention as described herein.

The present invention also relates to making the area within the pump and within the bottles moisture-resistant, and/or air-tight and or light-resistant so as to protect the properties of the flowable materials that are to be dispensed. The use of seals, dark plastic and anti-corrosive materials, etc in order to accomplish these ends would be within the skill in the context of the dispensing pump of the invention as described herein.

Because a dispensing pump of the invention is adapted to be connected to two or more containers liquids, gels, slurries and/or pastes, said liquids, gels, slurries and/or pastes may be kept out of physical contact with each other until after they have been dispensed from the dispensing element. According to an embodiment of the invention, the dispensing element may be constructed so as to present an individual outlet for said dispensing pump. In such a case, liquids, gels, slurries and/or pastes from the various containers may be mixed by the consumer after dispensing.

In an alternate embodiment of the invention, the dispensing elements in flow communication with each corresponding container, may merge the outgoing product streams so as to present one individual outlet alone for said dispensing pump. In such a case, liquids, gels, slurries and/or pastes from each corresponding container may be mixed just before, or just as they are exiting from the dosing pump of the invention.

An advantage of a dosing pump of the invention, is that it can dispense, simultaneously, or nearly simultaneously, equal amounts of different materials which are store in different containers affixed or attached to the dosing pump. Alternatively, a dosing pump of the invention can dispense, simultaneously or nearly simultaneously, unequal amounts of different materials which are being stored in different containers which are affixed or attached to a dosing pump of the invention. This may be accomplished for example, by varying the volumes of each cylindrical chamber and/or varying the size of each piston or bellows or in other manners that are conventional in the art.

Dosing pumps of the invention may be fabricated from hard or flexible plastics, or metals which are known in the art. Parts for dosing pumps of the invention may be fabricated by metal casting in the case of metals. Injection molding, for example, may be used as a technique for fabricating plastic parts of dosing pumps of the invention. Dosing pumps of the invention are then assembled in a manner which is conventional to the art or which is analogous to those types of assembly which are conventional to the art.

A piston may be sealingly mounted in a cylindrical chamber of the liquids, gels, slurries and/or pastes assembly of a dosing pump of the invention with a suitable material such as a hard rubber or an elastomer. The piston can have a flange, sleeve or other equivalent device so as to cause the seal between the piston wall and the inner wall of the cylindrical piston chamber.

An outlet valve means may be designed to be in flow communication with the inlet valve means, while the piston is being urged to the dispensing position; and the outlet valve means may be cut off from flow communication while the piston is being urged to the rest position, by having the outlet valve means and the inlet valve means constructed as sealing flaps, or other equivalent structures.

The inlet valve means may be designed to be in flow communication with the dip tube in the container, and the cylindrical chamber, while the piston is being urged to the rest position. The outlet valve means may be designed to be in flow communication with the dispensing element and the cylindrical chamber, while the piston is being urged to the dispensing position by having the inlet valve means constructed as sealing flaps.

Construction of dosing pumps of the invention so that the inlet valve means and the outlet valve means are disposed or embedded in plates situated between the two or more cylindrical chambers and the dip tube and corresponding container enables the dosing pumps of the invention to be made with relatively few parts and thus allows the dosing pumps of the present invention to be economical and less subject to breakdown. As will be described below, in one embodiment of the invention, there is present a top plate, a gasket, and a bottom plate which are mechanically and/or adhesively connected. The inlet valve means and the outlet valve means can be flexible flaps from the gasket, which can be rubber, or elastomer coming in contact with the top plate and the bottom plate or coming in contact with ridges extending from the top or bottom plate. It will be appreciated that there are other configurations which can consist of more than three plates and/or gaskets which can make up the inlet valve means and the outlet valve means in accordance with the scope of the present invention.

It will also be appreciated that the plate and gasket arrangement that make up the inlet valve means and the outlet valve means can be arranged to have one pump assembly so as to dispense flowable material from a single bottle or container, and through a single dip tube, and this also falls within the scope of the present invention. It will still also be appreciated that the use of plates and gaskets to form an the inlet valve means and the outlet valve means is especially well suited for the preparation of dispensing pumps which can dispense flowable material from two or more bottles or containers.

The following is a detailed description of a pump which is an embodiment of the invention.

Figure 1:
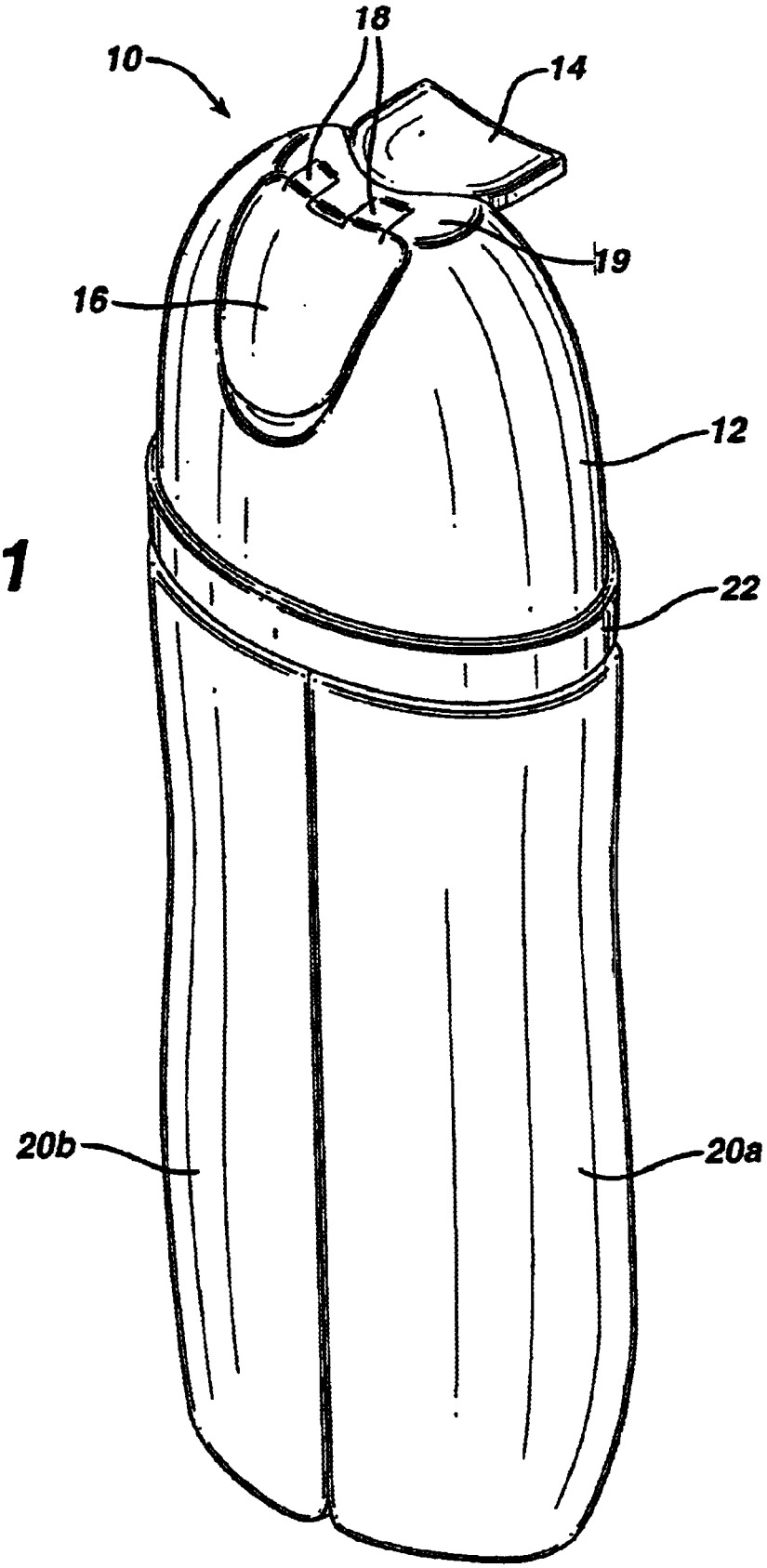
FIG. 1 is a perspective view of an embodiment of the invention which illustrates the cap and containers.

FIG. 1 depicts an illustrative form of the dosing pump 10 of the present invention, whereby a shroud 12 of an embodiment of the dosing pump 10 is connected to, for example, two bottles 20*a* and 20*b*. Extending out from the top of shroud 12 is button tab 14 that is generally pressed in a direction to force material out of the dosing pump 10. Dispensing exit nozzle cover 16 is connected by hinges 18 to roof 19 of shroud 12 to cover exit holes (not shown) thereby preventing damage to material (not shown) that has not been discharged for use. Shroud skirt 22 is connected via ribs (not shown) to bottles 20*a* and 20*b* and shroud 12 to keep the shroud 12 and bottles 20*a* and 20*b* connected.

Figure 2:
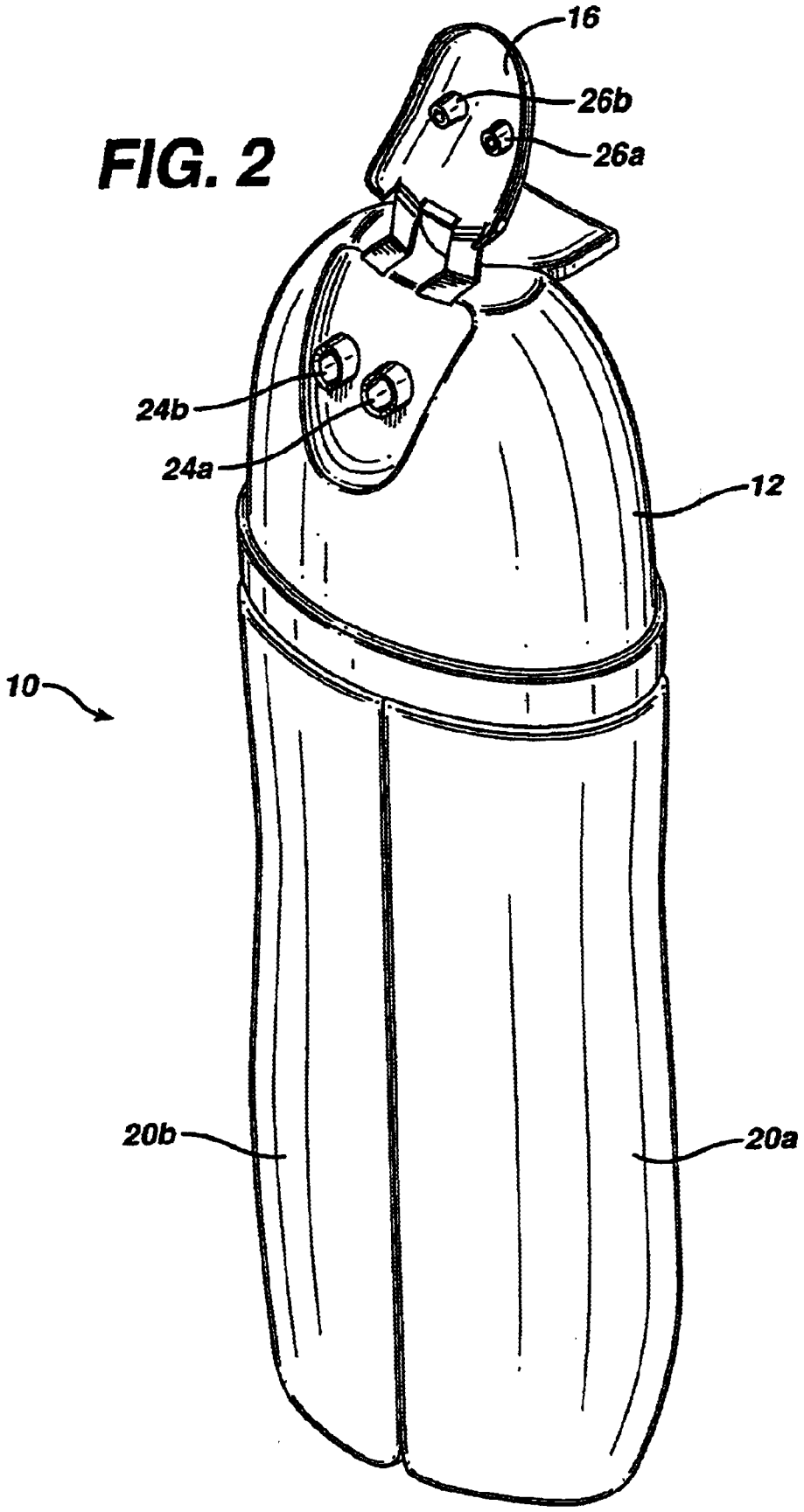
FIG. 2 is a perspective an embodiment of the invention which illustrates the cap and the containers and which shows the shroud cover for the dispenser nozzles an open and ready to dispense position.

FIG. 2 depicts dispensing pump 10 of the invention having exit nozzle cover 16 in the open position. Thus, exit nozzle cover 16 is in the open and ready to dispense material position, thereby exposing two material exit nozzles, 24*a* and 24*b* that are positioned under nozzle cover 16. Nozzle cover 16 comprises two exit plugs 26*a* and 26*b* that plug material exit nozzles 24*a* and 24*b* when nozzle cover 16 is closed in a position that forms a portion of the contour of shroud 12.

Figure 3:
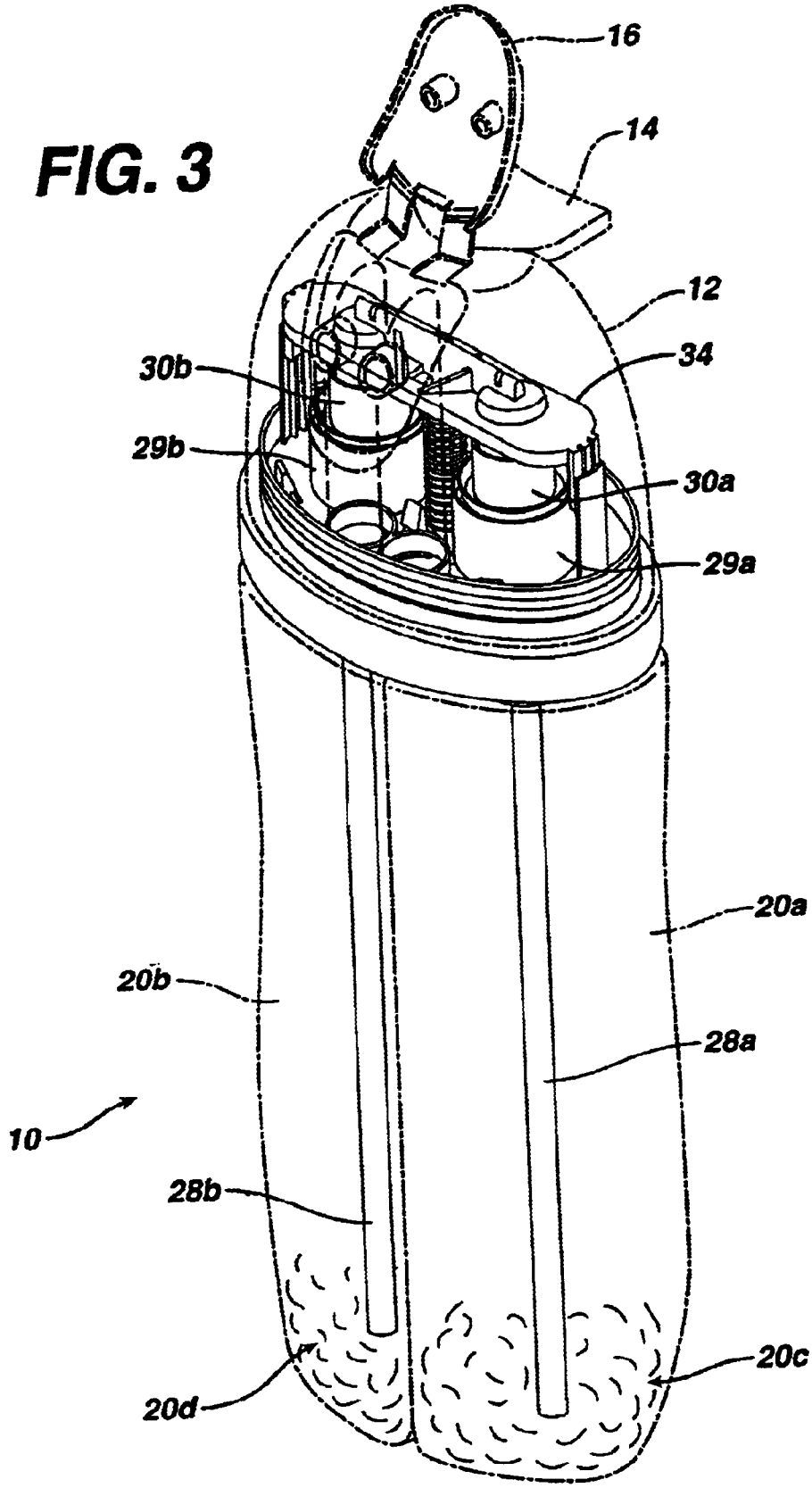
FIG. 3 is a perspective view of an embodiment of the invention with the cap and containers drawn in broken line form to show the dispensing valve assembly.
Figure 3A:
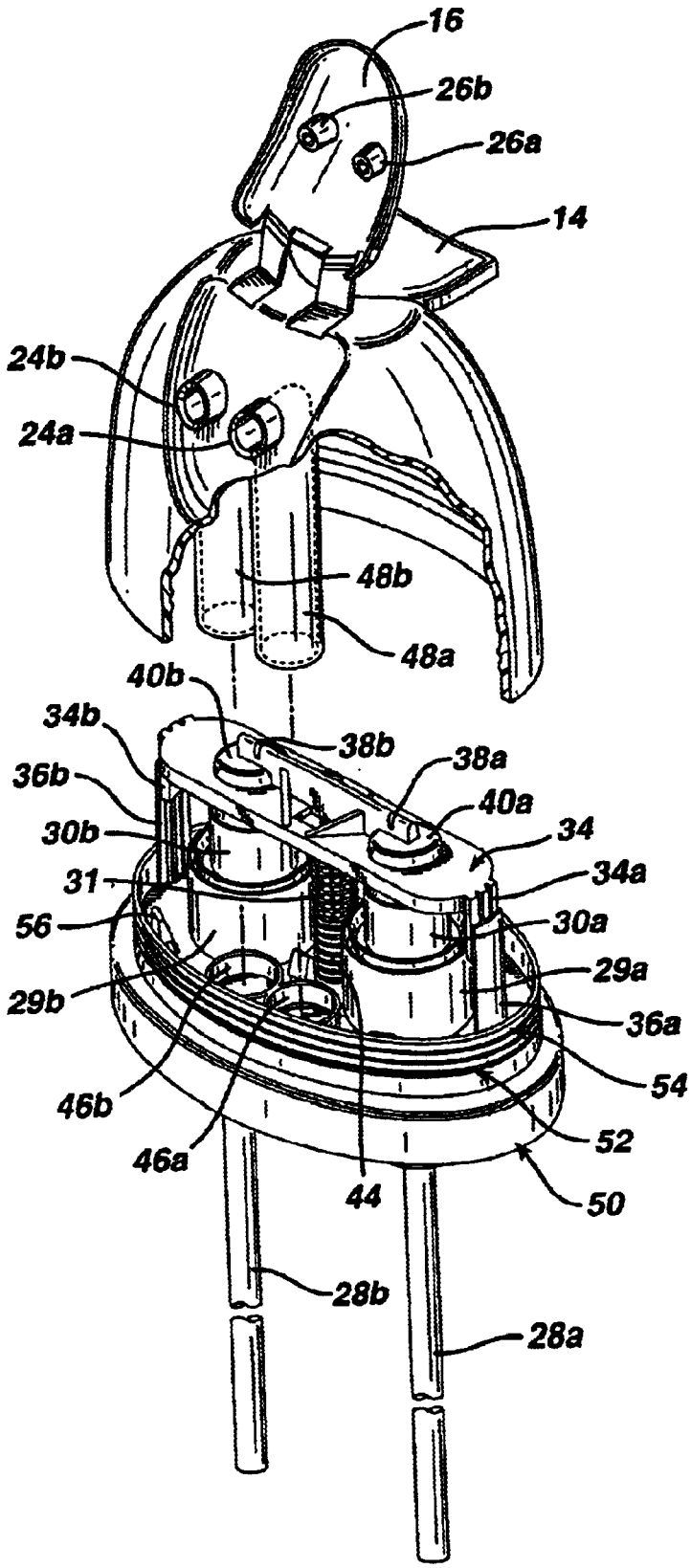
FIG. 3*a* of the dispensing valve assembly exploded for clarity.

FIG. 3 and FIG. 3*a* illustrates the dispensing pump 10 of the present invention. Dip tubes 28*a* and 28*b* extend from inlet valve means (not shown in this view) into bottles 20*a* and 20*b,* respectively. Suction from the inlet valve means, during the upstroke of the pistons 30*a* and 30*b* to a piston rest position, draws material 20*c* and 20*d* from bottles 20*a* and 20*b* through the inlet valve means into piston cylinders 29*a* and 29*b,* respectively. Tie bar 34 mechanically engages tie bar guides 36*a* and 36*b* through tie bar ribs 34*a* and 34*b*.

Tie bar slots, 38*a* and 38*b* are disposed within tie bar, 34, and above piston tops, 40*a* and 40*b*. Tie bar post, 31, extends downwardly from tie bar, 34. Tie bar guide well, 44, extends upwardly from top plate, 54. Top plate, 54, is mechanically or moldably or adhesively engaged with gasket, 52, and through fasteners, 56. Gasket, 52, is, in turn, mechanically or adhesively connected to bottom plate, 50. Exit posts, 48*a* and 48*b,* shown in broken line form, extend upwardly from outlet valve ports, 46*a* and 46*b* respectively.

Figure 4:
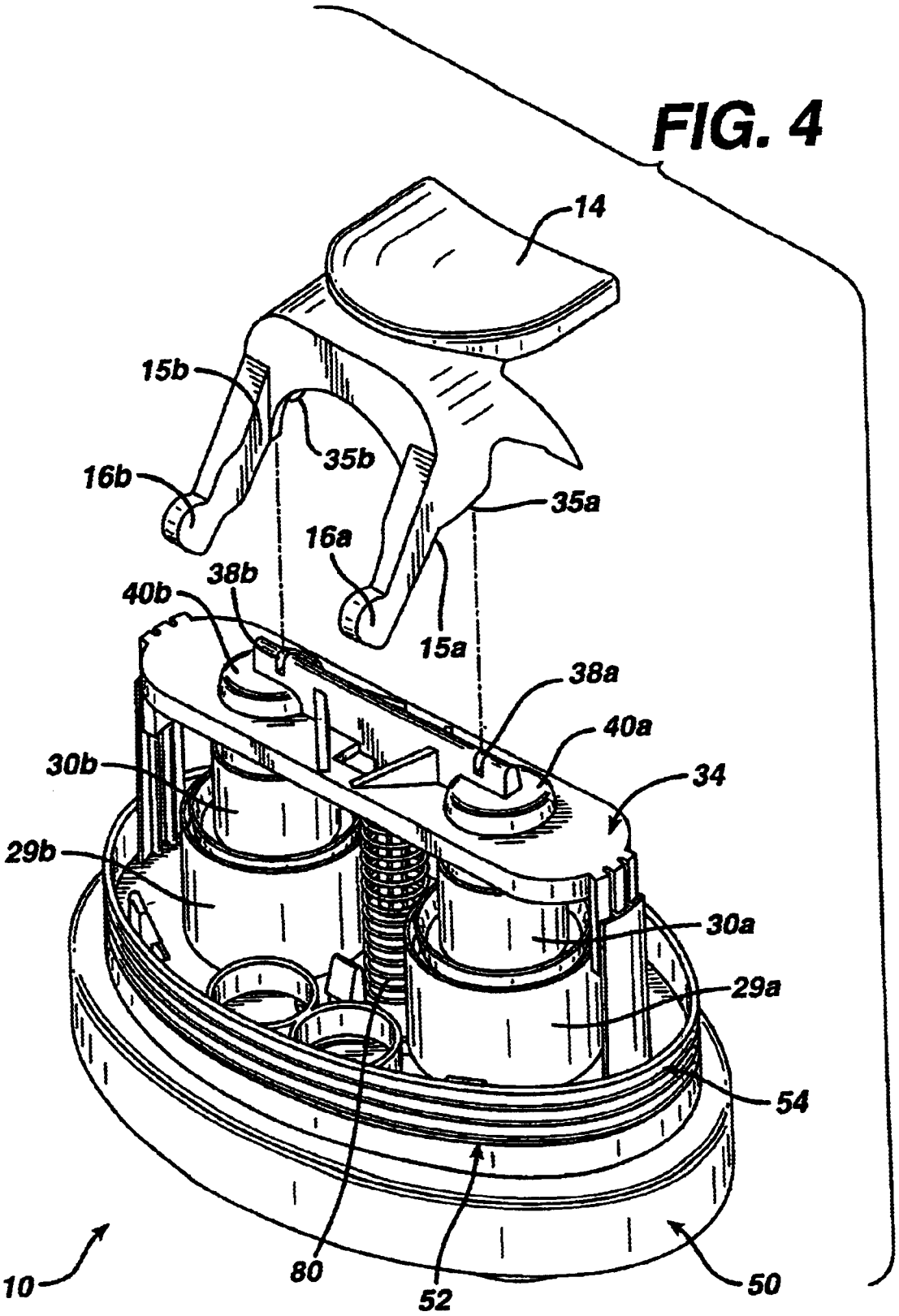
FIG. 4 is a perspective view of an embodiment of the invention showing the dispensing valve assembly with the dispensing button exploded for clarity.

FIG. 4 is an exploded view of the top portion of an embodiment of pump 10 of the invention. FIG. 4, shows in more detail, a button tab, 14, and button legs, 16*a* and 16*b*. Specifically, there are shown button slots, 15*a* and 15*b,* which, when the pump 10 is in operation, rest on tie bar slots, 38*a* and 38*b* respectively. When button tab, 14, is pressed, the button assembly pivots on tie bar slots, 38*a* and 38*b,* which cause bottom bars 35*a* and 35*b,* to mechanically depress tie bar 34 which in turn moves piston tops, 40*a* and 40*b,* and pistons 30*a* and 30*b,* to cause dispensing of product from piston chambers, 29*a* and 29*b*. The tie bar and the piston tops can be considered to be actuators as described above.

Figure 5:
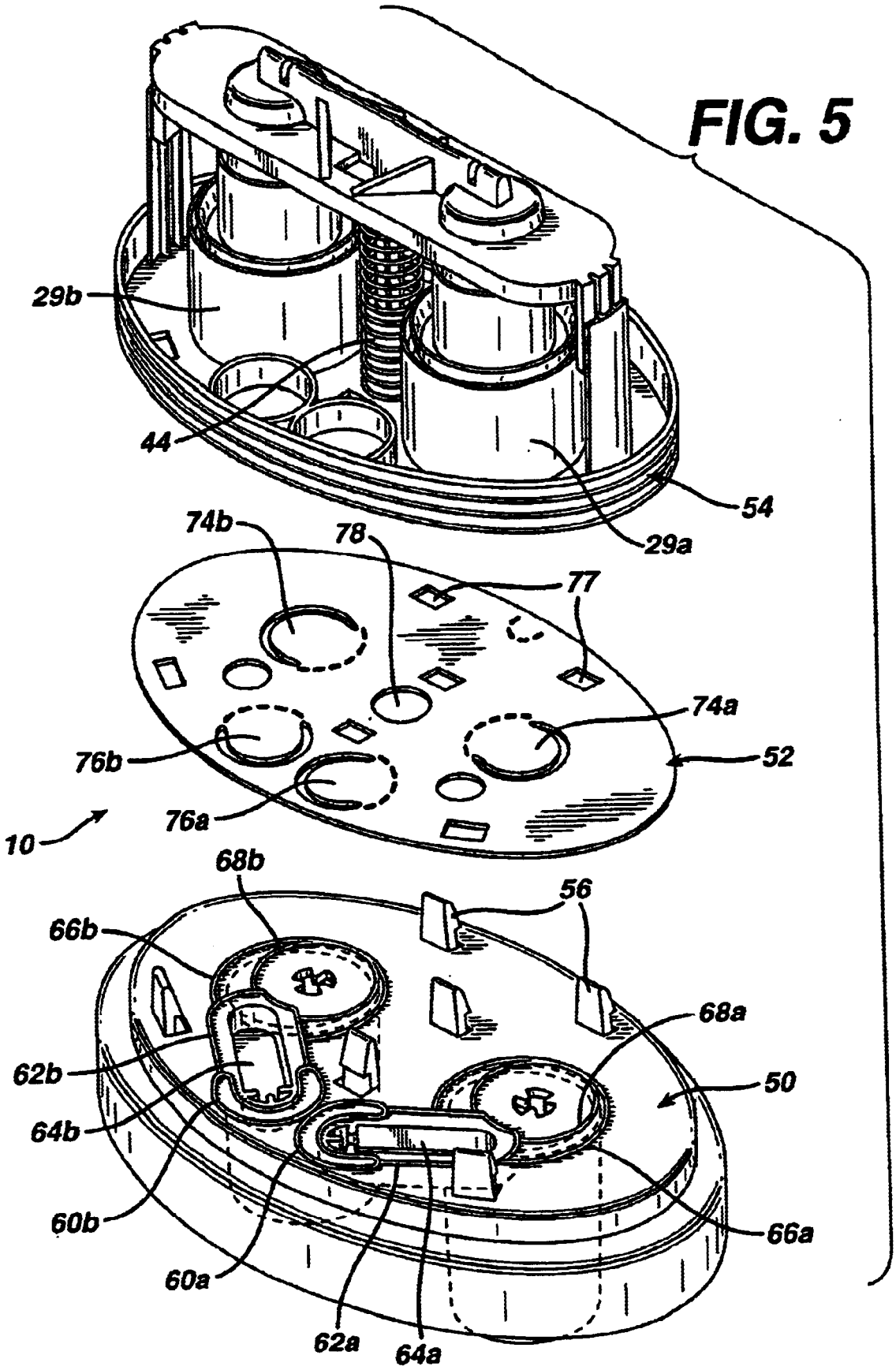
FIG. 5 is an exploded perspective view of an embodiment of a dispensing valve assembly of the invention (the upper assembly, gasket/valve/diaphragm, lower mounting plate)

In FIG. 5, is shown an exploded, perspective view of components of pump, 10, which is an embodiment of the invention, these components being: bottom plate, 50, gasket, 52, and top plate, 54. Bottom plate, 50, has six fastening tabs, 56, which secure bottom plate, 50, to gasket, 52, and top plate, 54. It will be understood that more or less than six such fasteners can be used, and that a fastener can be moved to the proximity of exit flaps, 76*a* and 76*b,* to prevent product leakage.

Bottom plate, 50, has ridges in crescent shapes, 60*a* and 60*b;* ridges in elongated oval shapes, 62*a* and 62*b;* and wells, 64*a* and 64*b,* in association therewith and in communication with circular ridges, 66*a* and 66*b,* and inner circular ridges, 68*a* and 68*b*. Gasket, 52, has two inlet flap valves, 74*a* and 74*b,* and two exit flap valves, 76*a* and 76*b*. Six square shaped openings 77 are for fastening tabs 56. Circular opening, 78, is for placement of tie bar guide well 44.

Figure 6:
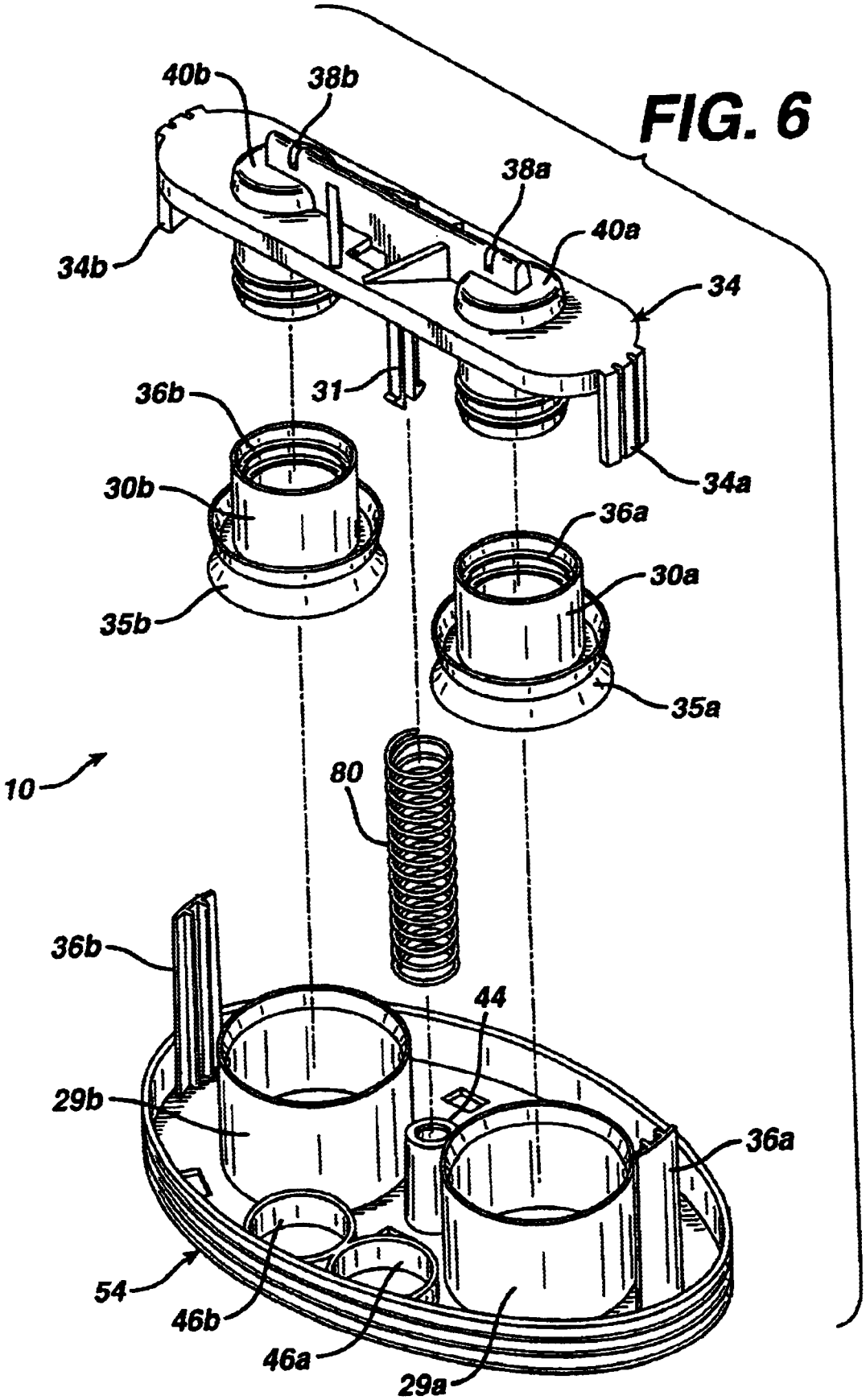
FIG. 6 is an exploded perspective view of an embodiment of an upper assembly of the invention.

FIG. 6 is an exploded view of the pumping assembly of pump, 10, an embodiment of the present invention. In this view, pistons 30*a* and 30*b* comprise respectively piston flanges 35*a* and 35*b* which are sealably and slidably positioned or mounted within piston cylinders 29*a* and 29*b* respectively when the components are assembled. Piston tops 40*a* and 40*b* respectively are mechanically engaged with piston bodies 36*a* and 36*b* respectively.

Figure 7:
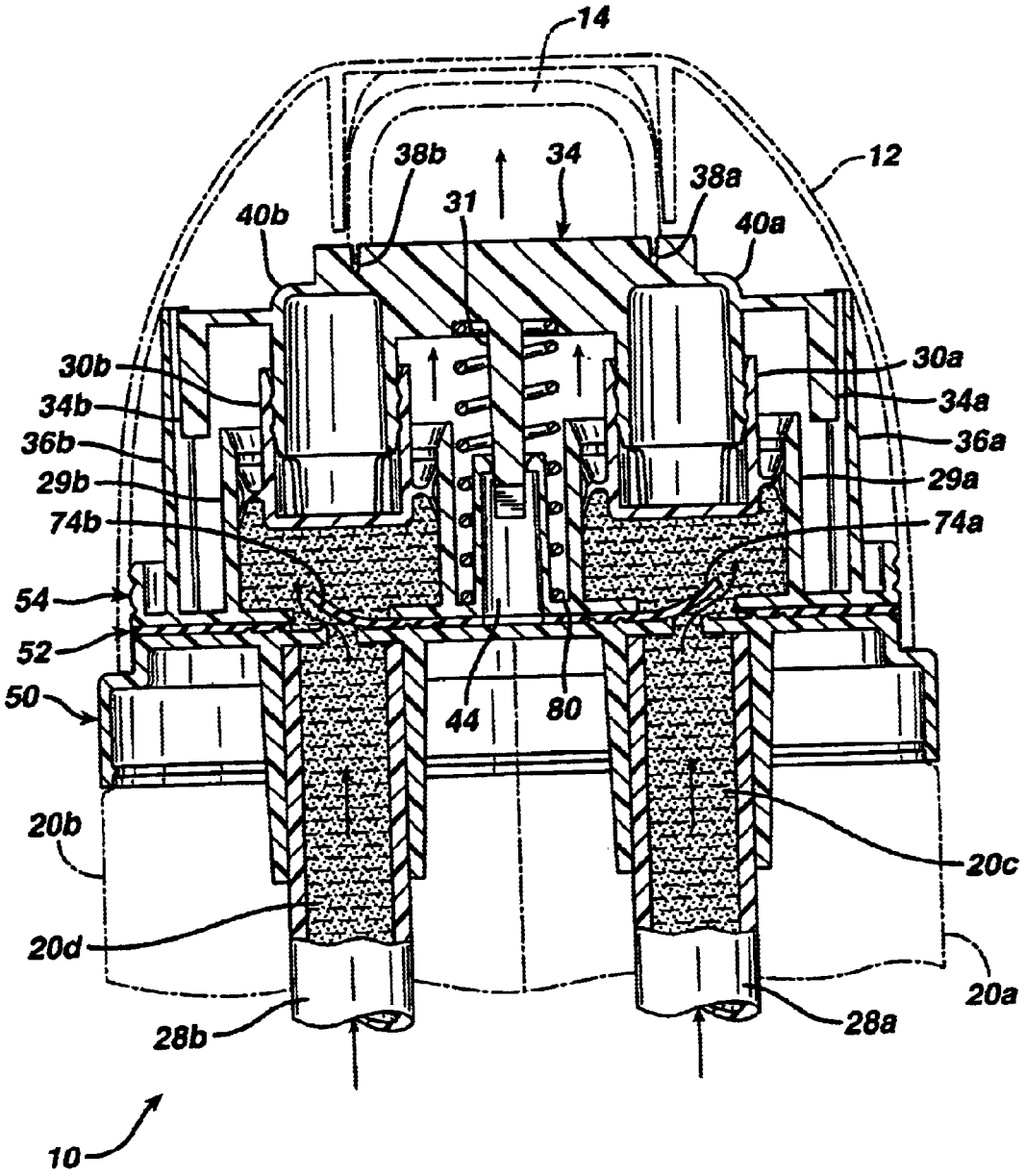
FIG. 7 is a cross-sectional view of an embodiment of the invention showing the upstroke.

FIG. 7, shows pump 10, an embodiment of the invention, during the upward stroke of said pump, when pistons 30*a* and 30*b* move upwardly under pressure from spring 80 (this will typically happen following a downstroke by the consumer. The downstroke is described below.)—inlet flaps valves, 74*a* and 74*b*, are drawn upward, away from bottom plate, 50, by suction caused by the upward movement of products 20*c* and 20*d,* causing flow communication between dip tubes, 28*a* and 28*b,* and the contents of bottles, 20*a* and 20*b;* (not shown) thereby drawing said contents upwardly into piston cylinders or chambers 29*a* and 29*b*.

Figure 8:
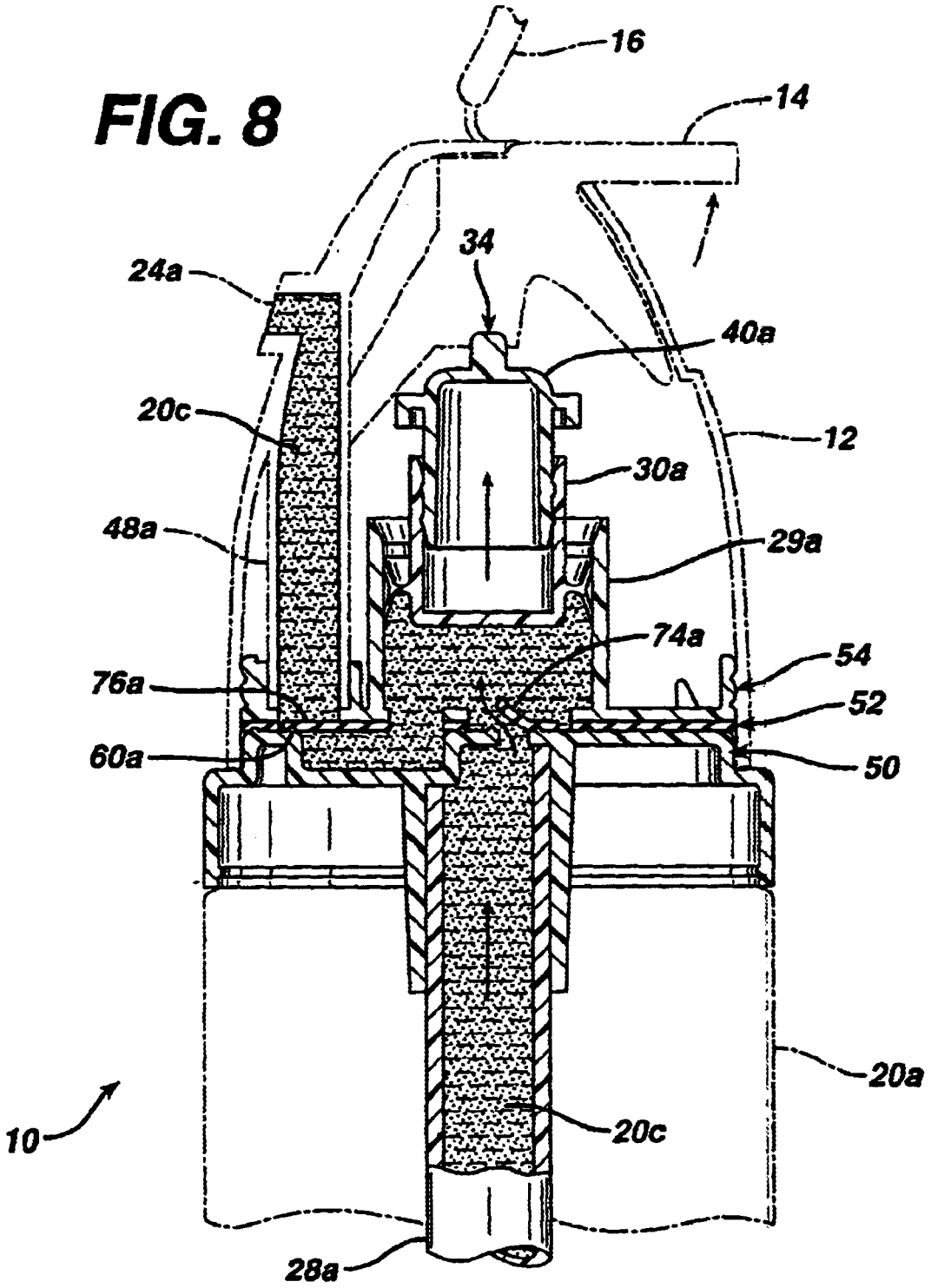
FIG. 8 is a cross-sectional view of the dispensing valve assembly of an embodiment of the invention taken along the plane between two bottles 20*a* and 20*b* showing the upstroke of the cylindrical valve cylinders.

FIG. 8 shows that during the upward stroke, exit valves flaps, 76*a* and exit valve flap 76*b,* (not shown) are drawn downward against crescent shaped ridge 60*a* and crescent shaped ridge 60*b,* (not shown) in bottom plate, 50, thereby cutting off flow communication between exit post, 48*a* and exit post 48*b,* (not shown) and piston cylinder, 29*a* and piston cylinder 29*b* (not shown).

Figure 8A:
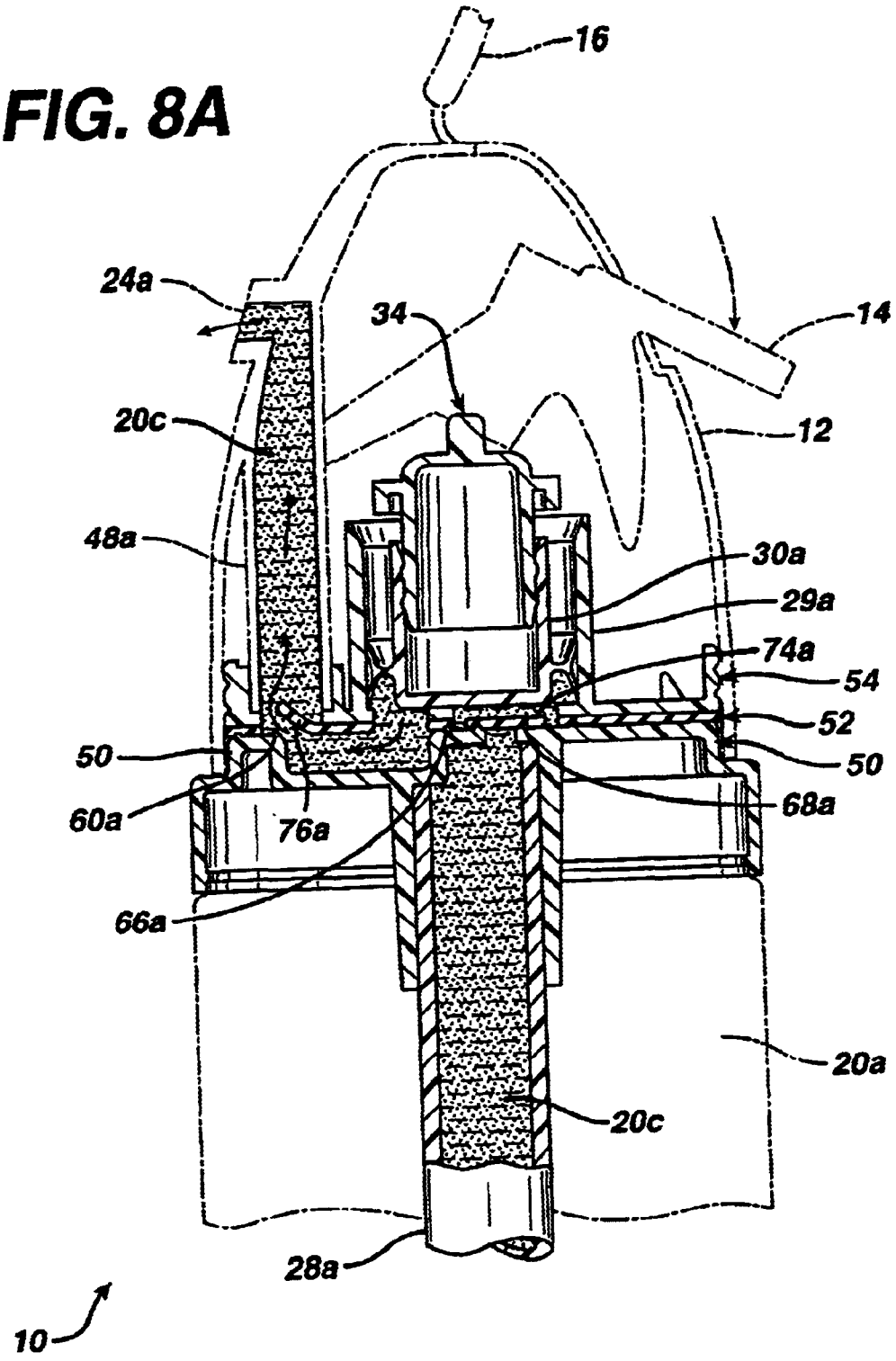
FIG. 8*a* is a cross-sectional view of an embodiment of the invention taken between two bottles 20*a* and 20*b* showing the downstroke of the cylindrical valve cylinders.

FIG. 8*a,* shows an embodiment of the invention, namely, pump 10, in a downward stroke. During the downward stroke, the contents within piston cylinders, 29*a* and piston cylinder 29*b* (not shown), are being forced out by mechanical pressure from piston, 30*a* and piston 30*b* (not shown). The pressure of the contents forces exit flap valve, 76*a* and exit valve flap 76*b* (not shown), up and away from crescent ridges or beads 60*a* and crescent ridges 60*b* (not shown), and bottom plate, 50, and thereby opens flow communication between piston chambers or cylinders, 29*a* and 29*b* (not shown, and exit posts, 48*a* and 48*b* (not shown). Product travels from exit posts, 48*a* and 48*b* (not shown) through exit nozzles, 24*a* and 24*b* (not shown), to the consumer. During the downward stroke, inlet flap, 74*a* and 74*b* (not shown), are forced against beads 66*a* and 66*b* (not shown) and inner circular ridges 68*a* and 68*b* (not shown), of bottom plate, 50, thereby cutting off flow communication between bottles, 20*a* and 20*b* (not shown), and piston cylinders, 29*a* and 29*b* (not shown).

A dosing pump of the invention may be used in order to dispense the following two compositions in a simultaneous or nearly simultaneous fashion, with each composition being placed in a different bottle. These two compositions are components in a hair coloring and conditioning composition that is designed to be dispensed by the consumer simultaneously and then mixed and applied to the hair.

EXAMPLE #1

| Dark Brown Color conditioner: Part A | |
|---|---|
| DI Water | 70.00 |
| Stearamidopropyl dimethylamine | 0.50 |
| Dicetyldimonium chloride/PG, 68%/27% | 2.10 |
| Stearyl alcohol and Ceteareth-20, 70% | 1.00 |
| Cetyl alcohol | 3.60 |
| DI water | 3.00 |
| Disodium EDTA | 0.10 |
| Dimethicone 100% | 1.00 |
| DC silicone fluid 245 | 1.80 |
| Kathon CG 1.5% | 0.08 |
| DMDM Hydantoin 55% | 0.10 |
| Fragrance | 0.20 |
| Sodium metabisulfite | 0.10 |
| DI water | 15.11 |
| m-Aminophenol | 0.03 |
| Rodol Grey HED | 0.13 |
| p-Phenylenediamine | 0.45 |
| o-Aminophenol | 0.05 |
| Resorcinol | 0.25 |
| Sodium hydroxide 50% | 0.40 |
| PH = 8 to 9 | |
| Dark Brown Color conditioner: Part B | |
| DI Water | 74.00 |
| Liquid Citric acid, 50% | 0.20 |

-continued

| | |
|---|---|
| Stearamidopropyl dimethylamine | 0.50 |
| Dicetyldimonium chloride/PG, 68%/27% | 2.10 |
| Stearyl alcohol and Ceteareth-20, 70% | 1.00 |
| Cetyl alcohol | 3.80 |
| DI water | 5.00 |
| Disodium EDTA | 0.10 |
| Dimethicone 100% | 1.00 |
| DC silicone fluid 245 | 1.80 |
| Hydrogen Peroxide(35%) | 10.00 |
| DMDM Hydantoin 55% | 0.10 |
| Fragrance | 0.20 |
| Phisphoric acid, 85% | 0.09 |
| PH = 3.0 | |

These above compositions may be made by conventional means.

This example is illustrative, and is not meant to limit the scope of the present invention.

The foregoing written description relates to various embodiments of the present invention. Numerous changes and modifications may be made therein without departing from the spirit and scope of the invention as defined in the following claims.

What is claimed is:

1. A dosing pump for dispensing two or more liquids, gels, slurries and/or pastes and adapted to be connected to two or more containers for said two or more liquid, gel, slurry and/or paste, which comprises an operating button, and two or more liquid, gel, slurry and/or paste dispensing assemblies, each liquid, gel, slurry and/or paste dispensing assembly comprising an actuator, wherein each actuator is in mechanical contact with said operating button and is simultaneously or nearly simultaneously actuated by movement of said operating button, wherein each liquid, gel, slurry and/or paste dispensing assembly further comprises:

a) a dispensing element;

b) a cylindrical chamber in flow communication with the dispensing element;

c) a piston or bellows sealingly and slidably mounted within said cylindrical chamber;

having a stroke for motion between a rest position and a dispensing position at corresponding opposite rest and dispensing ends of the stroke;

d) an inlet valve means in fluid connection with an outlet valve means, wherein said inlet valve means is in fluid connection with a container; and wherein said outlet valve means is in fluid connection with said dispensing element; and wherein said inlet valve means and said outlet valve means are embedded in one or more plates situated between said corresponding container and said cylindrical chamber;

wherein said inlet valve means is in open position and said outlet valve means is in closed position when said piston or bellows is urged in the direction of the rest position, thereby providing fluid communication between said inlet valve means, said cylindrical chamber and said container; thereby drawing by vacuum pressure liquid, gel, slurry and/or paste from said corresponding container to said corresponding cylindrical chamber;

and wherein said inlet valve means is in closed position and said outlet valve means is in open position when said piston or bellows is urged in the direction of the dispensing position, thereby providing fluid communication between said cylindrical chamber, said outlet valve means and said dispensing element;

thereby dispensing liquid or paste from said dispensing element by mechanical force.

2. A pump in accordance with claim 1 which comprises two liquid, gel, slurry and/or paste dispensing assemblies.

3. A pump in accordance with claim 1 wherein each said actuator is rigidly and mechanically connected to said other actuators by a tie bar which in turn is in contact with said operating button.

4. A pump in accordance with claim 1 which further comprises a covering which is contiguously disposed with said operating button and with each said dispensing element and which adjoins a top plate which carries said dispensing assemblies.

5. A pump in accordance with claim 1 wherein said inlet valve means and said outlet valve means and a channel which communicates therebetween is embedded in a valve plate which is disposed below a top plate, which carries said liquid, gel, slurry and/or paste dispensing assemblies, and wherein said inlet means is axially aligned with said piston or bellows.

6. A pump in accordance with claim 1 wherein each inlet valve means is a flap valve.

7. A pump in accordance with claim 1 wherein each outlet valve means is a flap valve.

8. A pump in accordance with claim 1 wherein said inlet valve means said outlet valve means and the channel therebetween are all embedded in a valve plate.

9. A pump in accordance with claim 1 wherein said inlet valve means said outlet valve means and the channel therebetween are all embedded partly in a valve plate and partly in a top plate.

10. A pump in accordance with claim 1, wherein each said liquid, gel, slurry and/or paste dispensing assembly comprises a piston sealably and slidably mounted with said cylindrical chamber.

11. A pump in accordance with claim 10 which further comprises a spring means for returning each piston to its corresponding rest position after said piston has been moved to its corresponding dispensing position.

12. A pump in accordance with claim 1 wherein one container contains an oxidative hair dye and another said container contains a developing solution.

13. A pump in accordance with claim 12 in which comprises non-corrosive materials.

14. A method for dispensing a liquid and/or paste which comprises dispensing said liquid and/or paste through a dosing pump according to claim 1.

15. A valve arrangement for a dosing pump for dispensing two or more liquid, gel, slurry and/or paste which comprises:

a) an inlet valve means adapted to receive a liquid or paste by vacuum pressure;

b) an outlet valve means adapted to receive a liquid or paste by mechanical pressure;

c) and a channel which is in fluid connection between said inlet valve means and said outlet valve means and where a), b) and c) are all embedded in one or more plates.

* * * * *